United States Patent [19]

Bompard

[11] 4,272,950

[45] Jun. 16, 1981

[54] FILIFORM TEXTILE MATERIAL

[75] Inventor: Bruno Bompard, Villeurbanne, France

[73] Assignee: Commissariat a l'Energie Atomique, Paris, France

[21] Appl. No.: 967,492

[22] Filed: Dec. 7, 1978

[30] Foreign Application Priority Date

Dec. 9, 1977 [FR] France .....77 37769

[51] Int. Cl.[3] ..... D02G 3/36

[52] U.S. Cl. ..... 57/232; 57/210; 57/229

[58] Field of Search ..... 57/210, 211, 229, 232, 57/234, 902

[56] References Cited

U.S. PATENT DOCUMENTS

| | | | |
|---|---|---|---|
| 3,029,589 | 4/1962 | Caroselli et al. | 57/211 X |
| 3,410,078 | 11/1968 | Freedman et al. | 57/232 X |
| 3,446,002 | 5/1969 | Kippan | 57/234 |
| 3,495,646 | 2/1970 | Marzocchi | 57/229 X |
| 3,565,127 | 2/1971 | Nicely et al. | 57/210 X |
| 3,644,866 | 2/1972 | Deardurff | 57/232 X |
| 3,857,229 | 12/1974 | Marzocchi | 57/234 X |
| 3,955,467 | 5/1976 | Johnson, Jr. | 57/210 X |
| 4,074,512 | 2/1978 | Matt | 57/210 |

*Primary Examiner*—John Petrakes

*Attorney, Agent, or Firm*—Kerkam, Stowell, Kondracki & Clarke

[57] ABSTRACT

Filiform textile material which can be used for producing a textile material used in the manufacture of laminated articles or which can be given a coating, constituted by a plurality of resin-preimpregnated continuous chemical filaments, wherein it is formed by at least one assembly having a plurality of non-polymerized or partly polymerized, resin-preimpregnated individual filaments covered by at least one layer of wrapping textile material which is not impregnated with resin.

11 Claims, 6 Drawing Figures

FILIFORM TEXTILE MATERIAL

BACKGROUND OF THE INVENTION

The present invention relates to a novel resin-preimpregnated, textile material which can in particular be used in the production of laminated articles or various coatings.

Laminated articles based on thermosetting or thermoplastic resin reinforced by a textile insert have long been known and are used for many different purposes in various fields.

In general, such articles are made by impregnating a textile reinforcing material, such as a fabric, felt, sheet of threads or the like. Optionally, the textile reinforcement can be obtained by superimposing several layers of the same or different types which may or may not be crossed, as a function of the mechanical characteristics which it is intended to give to the material.

Impregnation is preferably carried out by means of a thermosetting resin such as a phenol resin, epoxy resin or polyester resin, which is polymerised under the action of heat and/or pressure.

Moreover, for certain applications in which it is desired to obtain materials with a particularly high strength in all directions, and particularly a resistance to splitting off, it has been proposed to use as the textile reinforcing element three-dimensional articles, i.e. having threads in all three directions. Thus, it has been proposed to superimpose layers of longitudinal and transverse threads and to interconnect said layers by seams permitting the introduction of threads in the thickness direction of the article.

Other equivalent methods make it possible to obtain similar articles.

In general, threads which are not resin-impregnated and often called "dry threads" are used in the production of this type of textile reinforcing articles, impregnation taking place once the textile article is finished.

However, during the production of laminated articles, with a dense textile insert and/or a large thickness it is virtually impossible to obtain a homogeneous distribution of the resin up to the core of the material. This structural heterogeneity of the material leads to numerous problems such as irregular mechanical properties and the danger of splitting off when the material is in the form of several layers.

To solve this problem, and obtain a good impregnation by the resin, it has been proposed to use resin-preimpregnated textile sheets or threads. This preimpregnation can either be carried out beforehand on the thread which is to be used in the formation of the textile sheet, or by impregnating the sheet after its formation from the dry threads.

When it is desired to produce resin-impregnated threads comprising a plurality of substantially parallel filaments, impregnation is generally obtained by passing these threads througha resin bath and calibrating by means of a spinneret. These preimpregnated threads are used to make laminated materials in which layers of parallel threads are formed. The layers are optionally crossed relative to one another and the resin is polymerised after forming the layers.

This procedure makes it possible to produce articles in which the resin distribution is homogeneous, but it has been found that for certain applications, in which the laminated materials are subject to high stresses and loads, there is still a risk of splitting off between the various layers.

Moveover, it is relatively difficult to store such resin-preimpregnated threads and it is generally necessary when they are stored in the form of a coil to provide a separating element between each layer of turns, for example a sheet of siliconed paper which prevents sticking between the individual layers. Moreover, in this case, the coil cannot be formed from contiguous turns, which limits the quantity of material which can be stored on each coil.

Furthermore, due to their adhesive properties, it is not possible to partly or wholly used such preimpregnated threads for the production of conventional warp and weft fabrics and for the production of three-dimensional textile articles.

Finally, the thus preimpregnated threads are either in the form of a flat wick of limited thickness in which the filaments are parallel to one another or in the form of a substantially elliptical member, but it has been found that it is virtually impossible to obtain a thread with a strictly circular cross-section, which is particularly advantageous when making high density materials.

In addition, the cross-sectional shape of the threads produced in this way can be deformed of modified during subsequent manipulations, making numerous precautions necessary during the latter.

It has also been proposed to make partly polymerised resin-preimpregnated textile materials in order to eliminate the adhesive properties. These materials are either in the form of filiform elements or in the form of sheets of limited thickness. They have a certain rigidity, which facilitates their storage and optionally their use for certain special applications, for example when it is desired to produce articles having a complex shape in which it is necessary to cut the material either to a precise shape in the case of a sheet, or to a given length in the case of a filiform element.

In both cases, the thus produced resin-preimpregnated textile material has a substantially smooth outer surface and the resistance to splitting off between the different layers formed is limited then due to this surface state.

BRIEF SUMMARY OF THE INVENTION

The present invention provides a novel resin-preimpregnated filiform textile material which can be used in the production of laminated articles which overcomes the disadvantages of the prior art products and in particular makes it possible to easily store the preimpregnated materials and in particular to obtain a very good bond between the textile reinforcing material and the resin in the finished laminated article.

Moreover, the resin-preimpregnated filiform textile material according to the invention can be used for producing the two or three-dimensional textile reinforcing structure or can optionally be converted into a conventional warp and weft fabric, said material forming all or part of the thus obtained textile structure.

Optionally, the material according to the invention can undergo a partial prepolymerisation treatment in order to give it a certain stiffness facilitating storage, handling and use in certain special applications.

In a general manner, the filiform textile material according to the invention for producing textile inserts used in the manufacture of laminated articles comprises a plurality of resin-preimpregnated continuous chemical filaments, wherein the individual resin-preimpregnated filaments are covered by at least one wrapping textile material layer. In the present Application "wrapping textile material layer" is understood to mean a thread which is not impregnated with resin of a similar or different nature to those of the resin-preimpregnated filaments and which is wound round the preimpregnated filaments in the form of a helix with contiguous or non-contiguous turns.

According to the invention, this wrapping textile material layer maintains the resin-preimpregnated threads in such a way that they have a strictly circular cross-section, whilst said wrapping layer also forms an outer surface with relief portions. The resin-preimpregnated multifilament chemical threads can be any threads conventionally used in the production of laminated articles, for example glass fibres, carbon fibres, etc, whilst said threads are impregnated with a conventional resin.

Furthermore, the wrapping thread which retains the thus resin-preimpregnated filaments is chosen from among the materials which are compatable with the resin and which can be of the same or a different nature to the preimpregnated filaments. Advantageously, the wrapping thread has a titre which is well below that of the system of filaments which it covers, said titre being advantageously half as great.

Such a preimpregnated filiform textile material can be used as it is, alone or combined with other non-impregnated textile materials, for example to produce two or three-dimensional sheets of fabrics. According to the invention and as a function of the articles which it is desired to produce, it is optionally possible to assemble several preimpregnated filiform textile materials, for example by wrapping. This assembly can either be obtained by twisting together the individual elements, or optionally by maintaining them parallel to one another and covering them with an external holding layer, also provided by wrapping. In the latter case and as a function of the number of the thus assembled threads, it is possible to vary the cross-sectional shape of the assembly and obtain for example elements of substantially rectangular, square or even triangular cross-section, or to vary the appearance and consequently the surface state of such a material by giving it the form of a chain, cord, spring, etc.

According to a variant of the invention, the resin-impregnated filiform textile material according to the invention may optionally undergo a partial polymerisation treatment, which makes it possible to obtain an article having a certain stiffness.

The invention also relates to a process for obtaining such a resin-preimpregnated filamentary textile material.

The process according to the invention comprises in per se known manner supplying a conventional wrapping spindle, said spindle being hollow, with a multifilament chemical thread forming the core and a wrapping thread, wherein the multifilament thread forming the core is preimpregnated with resin prior to it being covered by the wrapping thread and the assembly formed optionally undergoes a drying heat treatment prior to winding.

According to the invention, the preimpregnation of the core thread with resin is performed either upstream or downstream of the wrapping spindle, but at a point located between the top of the spindle and the point at which the wrapping thread is joined to the core thread.

Moreover, wrapping can either be effected with contiguous turns or optionally with spaced turns. It is also possible to surround the resin-preimpregnated core thread with two layers of superimposed wrapping threads, coiled in opposite directions.

Finally, the mutifilament threads used for forming the resin-preimpregnated core are preferably untwisted threads with parallel strands.

BRIEF DESCRIPTION OF THE DRAWINGS

The invention will be described in greater detail hereinafter relative to non-limitative embodiments and with reference to the attached drawings, wherein show.

DETAILED DESCRIPTION OF THE PREFERRED EMBODIMENTS

Figure 1:
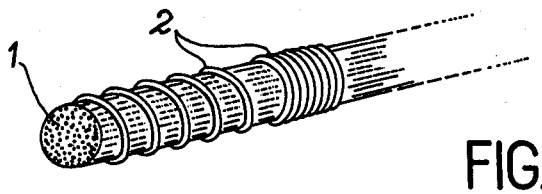
FIG. 1 a resin-preimpregnated filamentary textile material according to the invention.
Figure 6:
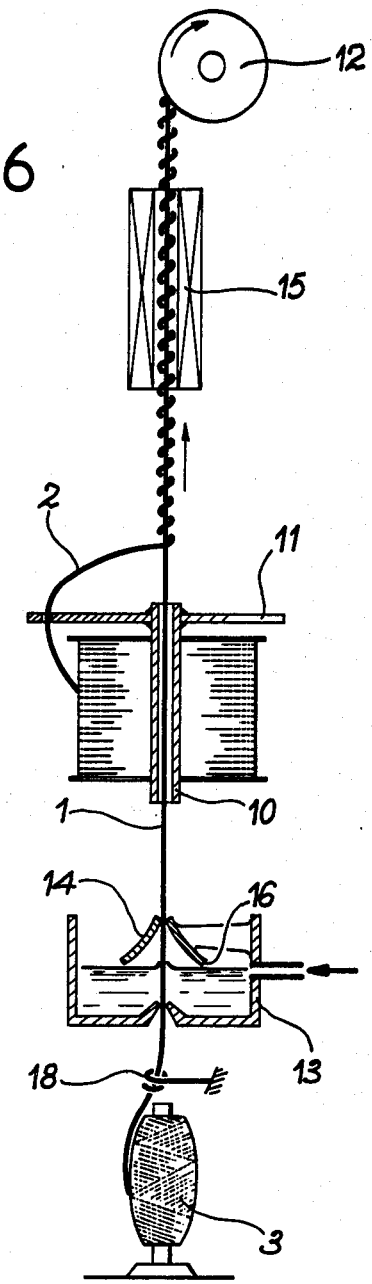
FIG. 6 an installation permitting the production of a resin-preimpregnated filamentary textile material according to the invention.

According to the installation described in FIG. 6, a preimpregnated filiform textile material according to the invention is produced in the manner shown in FIG. 1. This material is essentially produced on an installation comprising a hollow spindle 10 equipped with wrapping means 11. This conventional installation makes it possible to wind a wrapping thread 2 coming from a support which is fixed directly to the hollow spindle 10 around a core thread 1 coming from a fixed feed source 3 and maintained under tension by a yarn guide and which passes through the spindle 10. During the passage of the core thread through the spindle the wrapping thread is wound in the form of a helix around said core thread and the assembly is wound in the form of reels 12. The core thread is impregnated with resin prior to covering it with the wrapping thread. This impregnation process is advantageously performed by passing the thread through a tank 13 containing resin and then the thread is passed into a scraper 14 which removes surplus resin.

Moreover, after wrapping, the wrapped assembly is optionally passed into an oven 15 for the drying or prepolymerisation of the resin.

EXAMPLE

Using an installation as described hereinbefore, a multifilament glass thread 1 having 1600 parallel strands and of 6000 decitex is used. Preferably, supplying takes place by passing the thread from bottom to top. After removal from its support 3, the thread 1 passes into a tank 13 containing an impregnating resin and then through the hollow shaft of spindle 10.

The impregnating tank 13 is supplied with resin and has in its upper part a scraper 14, which ensures that only the desired quantity of substance is deposited on the filaments of thread 1. Advantageously, scraper 14 has inwardly inclined ledges 16 which help the excess resin to flow back into tank 13.

After passing through hollow spindle 10, the resin-preimpregnated thread 1 is wrapped with a glass filament-based thread 2, whose titre is 1360 decitex and which has 816 filaments. The passage speed of threads 1 and the rotation speed of spindle 10 are regulated in such a way that thread 2 encircles preimpregnated thread 1 in the form of substantially contiguous turns.

Advantageously, the assembly formed by the resin-preimpregnated thread 1 wrapped with enveloping thread 2 passes, after winding on at 12, into an oven 15 for drying or prepolymerising the resin.

The thus obtained resin-preimpregnated filiform textile material has a surface with protuberances and hollows formed by the wrapping thread around the preimpregnated core thread 1.

This thread can rapidly be wound in the form of reels 12 and there is no need to provide separating material layers to prevent sticking between the individual turns.

In addition, this thread has a substantially circular cross-section and has a relatively low resin level of the order of 20% by weight compared with the total weight, making it possible to obtain a preimpregnated thread whose volume is not greatly increased compared with a dry thread.

This thread can be used as it is, alone or combined with other threads of the same or a different nature to produce, for example, fabrics which are then used in the formation of laminated articles.

It may optionally be used in the production of coated fabrics. In this case, the thread is used in the warp and/or weft combined with other non-impregnated threads, for example using one preimpregnated thread for two non-impregnated threads. This procedure gives rigidity to the fabric formed, facilitates subsequent coating and increases the performance of the article.

Finally, for certain applications it is advantageous to polymerise to a greater or lesser extent the material obtained in order to give it a more or less great rigidity. In this case, it may optionally be cut into sections of predetermined length which can be used for providing multidirectional inserts.

It should be noted that for similar applications, laminated articles produced from the preimpregnated thread according to the invention either have a better resistance to splitting off than articles produced from preimpregnated threads with parallel strands, or give stiffness to the resulting products, for example in the case of coated fabrics.

In addition, and in a surprising manner, when the preimpregnated thread is not polymerised and stored in the form of a coil it is found tha the different layers do not tend to agglomerate together as is the case with preimpregnated threads with parallel strands.

As has been stated hereinbefore, such a thread can be used as it is. However, for certain applications it is possible to assemble several preimpregnated threads produced in this way.

Figure 2:
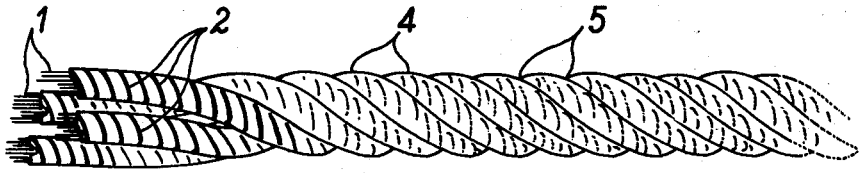
FIG. 2 a resin-preimpregnated textile material comprising several preimpregnated filamentary materials according to the invention which have been twisted together.

Thus, FIG. 2 shows an embodiment in which four preimpregnated threads are assembled by twisting. This makes it possible to obtain a larger diameter preimpregnated assembly, whose periphery has protuberances and valleys 4, 5, which greatly improve the bond with the impregnating resin or the coating material.

Figure 3:
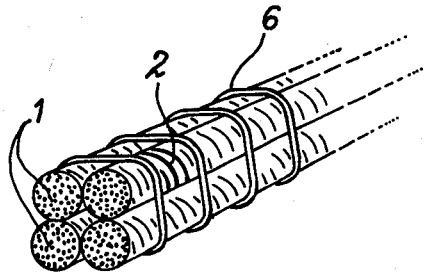
FIGS. 3 and 4 variants in which several resin-preimpregnated filamentary textile materials according to the invention are assembled and kept parallel to one another by means of a bonding layer formed by wrapping.
Figure 4:
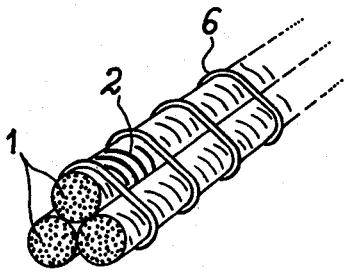

FIGS. 3 and 4 show embodiments in which several preimpregnated threads produced according to the invention are joined by means of a complimentary wrapping thread 6. As is apparent from FIG. 3, this procedure makes it possible to produce assemblies, whose cross-sectional configuration, appearance and external surface state can vary.

In FIG. 3, this shape is substantially square, whilst in FIG. 4 it is substantially triangular. This is made possible by the fact that the preimpregnated filiform textile elements have a substantially circular cross-section.

Figure 5:
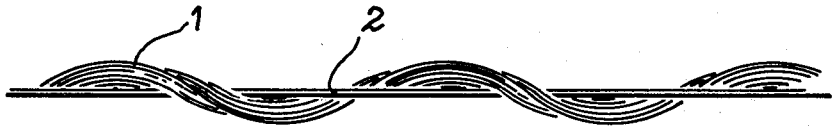
FIG. 5 a variant of the use of the material according to FIG. 1 in the form of a spiral.

Finally, and as is shown in FIG. 5 it is possible, prior to the use of the preimpregnated textile thread, to give it an overtwist in the wrapping direction, making it possible to pass the wrapping thread to the inside by giving it a substantially rectilinear orientation, the previously covered filaments 1 passing into the outside and forming convolutions around the thread encircling the wrapping thread.

Compared with prior art resin-preimpregnated textile materials, the material according to the invention is easy to handle and store and can be used in the production of any type of two or three-dimensional reinforcing textile materials. Moreover, it leads to a significant improvement in the properties of the laminated articles produced and in particular in their resistance to splitting off.

In addition, and as stated hereinbefore, it can be used to give stiffness to coated fabrics. In this case during the production of the fabric certain warp and/or weft threads are constituted by filiform textile elements according to the invention, whilst the other threads are of the same or a different type, but are not resin-impregnated.

The invention is not limited to the embodiments described and represented hereinbefore and various modifications can be made thereto without passing beyond the scope of the invention.

What is claimed is:

1. A filiform and flexible primary textile strand which is capable of being wound for storing with adjacent turns in direct contact one relative to the other before being used and which is capable of being woven, wherein said textile strand comprises at least one assembly of continuous chemical individual filaments covered by a thread of continuous chemical filaments around said assembly of individual filaments in the form of a helix, said strand having a substantially circular cross-section, said thread of continuous filaments forming an outer surface with protuberances and hollows, said assembly of individual filaments being preimpregnated with a nonpolymerized resin and said thread of continuous filaments being not impregnated with resin.

2. A primary textile strand according to claim 1, wherein said helix has contiguous turns.

3. A primary textile strand according to claim 1, wherein said helix has noncontiguous turns.

4. A primary textile strand according to claim 1, wherein the thread of continuous filaments is of the same type as the assembly of individual filaments.

5. A primary textile strand according to claim 1, wherein the thread of continuous filaments is of a different nature than the assembly of individual filaments.

6. A primary textile strand according to claim 1, wherein the titre of the thread of continuous filaments is less than that of the assembly of individual filaments.

7. A primary textile strand according to claim 1, wherein said strand comprises a combination of at least two assemblies, each of said assemblies being constituted by a plurality of individual filaments and covered by a thread of continuous filaments.

8. A primary textile strand according to claim 7, wherein at least one wrapping thread is wound round said combination of at least two assemblies.

9. A primary textile strand according to claim 8, wherein said strand comprises three assemblies and has a substantially triangular cross-section.

10. A primary textile strand according to claim 8, wherein said strand comprises four assemblies and has a substantially rectangular cross-section.

11. A reinforcing woven textile material including a primary textile strand as described in claim 1.

* * * * *